United States Patent [19]

Rineman

[11] 4,054,100

[45] * Oct. 18, 1977

[54] SPORT SAILBOAT

[75] Inventor: Richard Lynn Rineman, Brighton, Mich.

[73] Assignees: R. Lynn Rineman, Brighton; Harold J. Rineman, Southfield; S. Albert Young, Birmingham; Benjamin W. Colman, Huntington Woods, all of Mich.

[ * ] Notice: The portion of the term of this patent subsequent to Oct. 12, 1993, has been disclaimed.

[21] Appl. No.: 730,734

[22] Filed: Oct. 8, 1976

Related U.S. Application Data

[63] Continuation-in-part of Ser. No. 584,124, June 5, 1975, Pat. No. 3,985,090, and a continuation-in-part of Ser. No. 629,689, Nov. 6, 1975, Pat. No. D. 242,614.

[51] Int. Cl.[2] ..... B63H 9/04

[52] U.S. Cl. ..... 114/39; 114/102; 114/123

[58] Field of Search ..... 114/39, 61, 90, 91, 114/102, 104, 105, 108, 123, 163, 283, 292; 9/310 E; 280/16

[56] References Cited

U.S. PATENT DOCUMENTS

| | | | |
|---|---|---|---|
| 736,386 | 8/1903 | Hansen | 280/16 |
| 1,082,831 | 12/1913 | Stanbrough | 280/16 |
| 1,361,902 | 12/1920 | Porteous | 114/219 |
| 2,724,356 | 11/1955 | Szakacs | 114/39 |
| 2,944,505 | 7/1960 | Berge | 114/39 |
| 3,094,961 | 6/1903 | Smith | 114/39 |
| 3,173,395 | 3/1965 | Laurent | 114/102 |
| 3,223,064 | 12/1965 | White | 114/39 |
| 3,223,065 | 12/1965 | Wilson, Jr. | 114/123 |
| 3,259,093 | 7/1966 | Taylor | 114/39 |
| 3,336,890 | 8/1967 | Laurent | 114/123 |
| 3,349,741 | 10/1967 | Herbst | 114/39 |
| 3,455,261 | 7/1969 | Perrin | 9/310 E |
| 3,487,800 | 1/1970 | Schweitzer et al. | 114/39 |
| 3,762,353 | 10/1973 | Shutt | 114/39 |
| 3,802,366 | 4/1974 | Mankawich | 114/39 |
| 3,831,539 | 8/1974 | Black | 114/39 |
| 3,870,004 | 3/1975 | Bailey | 114/39 |
| 3,954,077 | 5/1976 | Piat-Marchand | 114/123 |
| 3,985,090 | 10/1976 | Rineman | 114/39 |

*Primary Examiner*—George E. A. Halvosa
*Assistant Examiner*—Stuart M. Goldstein

[57] ABSTRACT

A wind-propelled sailboat having a main hull and an outboard pontoon, a mast mounted upon the hull and a triangularly-shaped sail removably connected and secured at its peak to the top of the mast, the sail being controlled for propulsion of the boat by manually manipulated lines connected to each lower end of the sail, and manually controlled rudder means for steering of the boat. The sail is preferably not provided with a boom but is free for shifting either luff of the sail as a leading edge by means of the lines connected to the two lower ends of the sail. The sail-connected lines or sheets are each passed through swiveling blocks and locking cleats arranged for selectively drawing and releasably engaging the lines to draw the sail luffs taut. The distal ends of the lines are connected to and mounted upon spring-loaded take-up reels that retain distal end portions of the lines within the housings of the reels, preferably mounted within and below the cover or deck portion of the main hull, though the reels may be otherwise mounted upon the boat.

25 Claims, 6 Drawing Figures

SPORT SAILBOAT

CROSS-REFERENCES TO OTHER APPLICATIONS

This application is a continuation-in-part of my earlier-filed application Ser. No. 584,124 filed June 5, 1975 for "Sport Boat", which issued as U.S. Pat. No. 3,985,090 on Oct. 12, 1976; and a continuation-in-part of my earlier-filed design application Ser. No. 629,689 filed Nov. 6, 1975 for "Hull for a Sailboat", now allowed as U.S. Pat. No. D242,614.

BACKGROUND OF THE INVENTION

The art to which the invention relates is that of sport sailboats preferably designed for use and operation by a single person, although by suitable modification the boat can be arranged to accommodate more than one person.

Prior art sailboats having a generally outboard pontoon arrangement normally have the mast and sail positioned substantially medially on a platform section supported upon and between two lateral parallel pontoons, with a swinging boom having its proximal end connected to and supported from the lower portion of the mast, the sail extending substantially rearwardly from the mast, for control by the operator manipulating a conventional line system connected to the distal end of the boom. Some of these sailboats also have jib-type sails ahead of and connected to the main mast or foremast.

Another type of sailboat is that disclosed in Schweitzer et al U.S. Pat. No. 3,487,800 entitled "Wind-Propelled Apparatus", in which the mast for the sail is mounted upon a universally pivotable joint substantially on the longitudinal axis of a surfboard, with a pair of booms disposed substantially medially about and on either side of the sail, so that the person standing on the surfboard positions himself on either side of the sail, as may be required, to grasp the boom and thus support the mast and sail against the force of the wind. The operator permits the sail to swing into the wind, controlling its attitude and thereby the direction of the surfboard. In the event that the force of the wind should be overwhelming, the operator releases his grasp on the sail boom, allowing the sail and mast to fall away at the universal fitting into the water.

Another prior art sailboat with which the instant invention is related is that disclosed in Wilson U.S. Pat. No. 3,223,065 issued Dec. 14, 1965, having a main hull and a separate outboard float connected to the main hull by a grid-type platform from which a pair of rudders depend to steer and function as a keel. The sail is provided with a boom, said control lines being attached to the ends of the boom and passed through guide loops forming a part of the guy wires securing the mast.

SUMMARY OF THE INVENTION

The present invention relates to improvements in the sailboat disclosed in my earlierfiled application Ser. No. 584,124, to be issued as U.S. Pat. No. 3,985,090 on Oct. 12, 1976, and more particularly to the sail and its control by lines and means for engaging, securing and controlling the lines connected to the sail.

The hereindisclosed improvements in sail control materially and significantly simplify the control and function of the sport sailboat. The sailor operating the boat normally stands, or he may kneel or sit, on the platform web section, grasping one or the other of the two lines connected to the lower corners of the sail which is in triangular form, with its apex or peak supported from a swiveling revolvable masthead fitting adjacent the top of the mast. The rudder control lever is pivotally mounted by a universal joint, or other suitable coupling, affixed to the distal end of a shaft having a lever or bell crank mounted thereon under the main hull cover section and in the chamber formed thereby with the main hull underbody. Cables connect the rudder control bell crank lever to the rudder pivot levers within the main hull to simultaneously rotate the rudder shafts and their attached rudders in opposite directions, substantially as disclosed in my earlier-filed above-identified application Ser. No. 584,124.

The lines or sheets connected to the lower depending corners of the sail each extends through a swiveling block mounted upon the cover section of the main hull, through a gripper cam cleat with fairlead, and through an opening in the cover section of the main hull to a line take-up reel, preferably spring-loaded, that is affixed to or otherwise suitably mounted upon supporting structure within the boat between the main hull underbody and cover sections.

The sail which is generally triangular in shape and preferably in an isosceles form, may have its vertically disposed edges arranged in any suitable configuration. For sailing, the apex or peak of the sail is normally elevated to and adjacent the revolvable masthead fitting mounted upon the mast adjacent its upper end.

Steering of the boat is effected primarily by the rudders and their control mechanism, supplemented by the sail and its control system for establishing the desired sailing direction of the boat, to the left or the right of the sailor as he faces the mast.

DRAWINGS

Various further and more specific objects, features and advantages of the invention will appear from the description given below, taken in connection with the accompanying drawings, illustrating by way of example a preferred form of the invention. Reference is here made to the drawings annexed hereto and forming an integral part of the specification, in which FIG. 1 is a perspective view of a preferred embodiment of the invention, showing the line connected to the lower left corner of the sail cleated and engaged, with the left luff drawn taut, for sailing the boat in a direction to the left of the mast.

Figure 3:
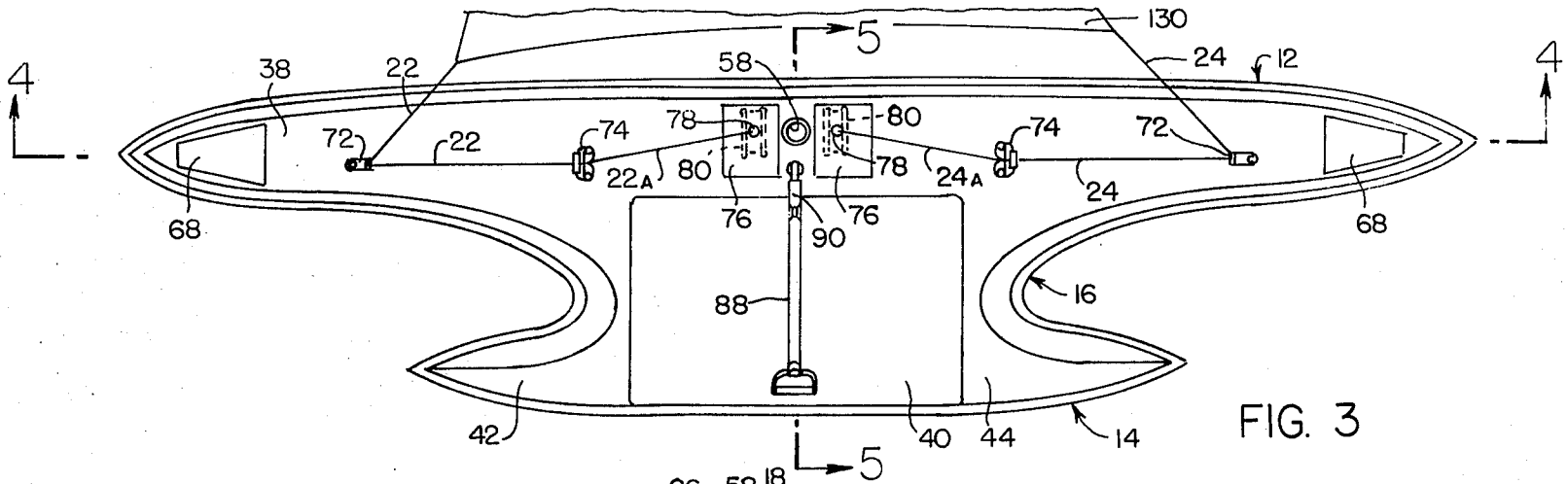
FIG. 3 is a top plan view of the hull of the sport sailboat with the lower portion of the sail shown fragmentarily.
Figure 4:
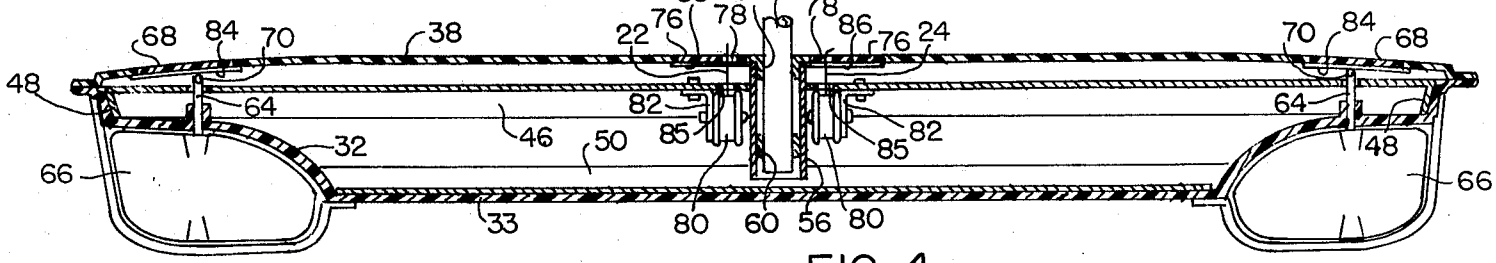
Figure 5:
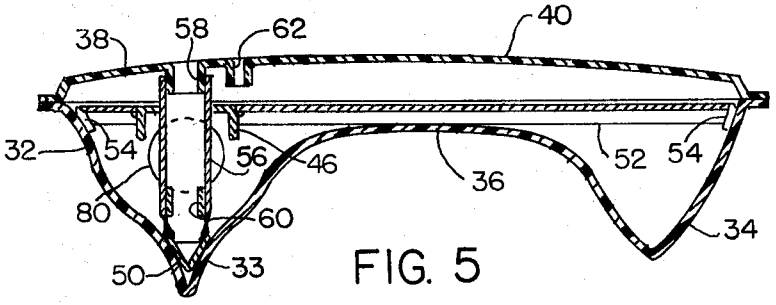

FIGS. 4 and 5 are vertical sectional views, longitudinal and transverse respectively, taken substantially on the line 4—4 and 5—5 of FIG. 3.

Figure 6:
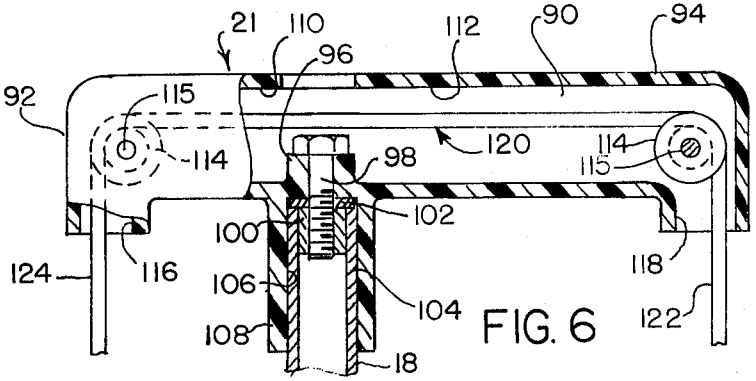

FIG. 6 is a fragmentary vertical elevational view, partly in vertical section, of the masthead fitting on the mast.

DESCRIPTION OF THE PREFERRED EMBODIMENT

A preferred embodiment of the invention, illustrated in the several views of the drawings annexed hereto, comprises the sport sailboat 10 having a main hull 12, an outboard pontoon or outrigger 14 connected to the main hull by an integral web and platform section 16, a mast 18 supported upon the main hull 12, a sail 20 connected to the mast at or adjacent its top, depending from a masthead fitting 21 revolvable on the mast, and controlled as to its attitude by lines or sheets 22 and 24 connected to the lower left and right corners of the sail respectively (taken from the vantage point of the sailor facing the mast), and manually operated rudder control mechanism 26.

As previously disclosed in my co-pending earlier-filed application Ser. No. 584,124, the main hull 12, the outboard pontoon 14 and the intermediate connecting web and platform section 16 are preferably made in two molded plastic parts conjoined at their outer edges or perimeters by any suitable means, a lower section 28 and a cover section 30. The lower section 28 comprises the main hull lower portion 32 having a keel portion 33, the outboard pontoon lower portion 34 and the intermediate web and platform lower portion 36. The cover section 30 comprises the main hull cover portion 38, the web and platform cover portion 40 and the adjacent lateral cover portions 42 and 44 overlying the outboard pontoon lower portion 34.

The main hull lower portion 32 is provided with a medial longitudinally extending channel member 46 from one longitudinal end to the other in the upper region of the portion. The longitudinal ends 48,48 of the channel member 46 are fixedly secured to the longitudinal ends of the lower portion 32 by any suitable means. A second longitudinally extending angle-type member 50 is disposed and secured in the bottom region of the main hull lower portion 32, substantially in parallel with the upper channel member 46. A transverse channel member 52, disposed medially of the boat (substantially on the line 5—5 of FIG. 3), is affixed to and in the plane of the longitudinally extending channel 46 and has one of its ends 54,54 secured to the side of the main hull lower portion 32 and its other end to the side of the outboard pontoon lower portion 34.

At the intersection of the longitudinally extending channel 46 and the transverse channel member 52, a mast support sleeve 56 is secured to the channel 46 by welding or other suitable means. The upper end of sleeve 56 is positioned about and in telescoping relationship with a bearing member 58 depending downwardly from the main hull cover portion 38, and the lower end of sleeve 56 is fixedly secured to the angle 50 disposed in the bottom of the main hull. An inner bearing 60 is secured to and within the lower portion of the sleeve 56 in alignment with the upper depending bearing member 58, so that the mast 18 is properly supported within the two bearing members 58 and 60.

The rudder steering mechanism 26 is substantially identical to the construction and mechanism disclosed in my earlier-filed application Ser. No. 584,124. The main hull cover portion 38 is provided with a depending sleeve or bearing 62 for the central shaft upon which the control bell crank is affixed, the control cables extending therefrom to the bell crank levers mounted on the rudder shafts 64,64 (FIG. 4) to rotate the rudders 66,66 in opposite directions.

The main hull cover portion 38 is provided adjacent each end thereof with hatches 68,68, arranged above the rudder bell crank levers 70,70 affixed to rudder shafts 64,64, to provide access to the same for repair or maintenance.

The sail control mechanism includes the lines 22 and 24, the swivel blocks 72,72 for these lines affixed to the main hull cover portion 38 adjacent the hatches 68,68, the locking or gripper cam cleats 74,74 for the lines, the central hatches 76,76 each having openings 78,78 through which the lines 22 and 24 pass to the take-up reels 80,80 mounted by brackets 82,82 to the longitudinally extending channel member 46 or other suitable support means, substantially in alignment with the openings 78,78 thereabove. Fairleads or eyestraps which are the equivalents of the blocks 72 may be used in their place.

The hatches 68,68 and 76,76 are preferably supported on inturned flanges 84,84 and 86,86 respectively extending inwardly of the openings which the hatches cover.

The locking cleat 74 affixed to the main hull portion 38 is secured thereto in a position intermediate the swivel block 72 and the opening 78 in the hatch 76 (FIG. 3), so that a fair amount of each line 22,24 is readily available to be grasped by the sailor standing on the platform portion 40. The lines 22 and 24 attached to the left and right corners respectively of the sail 20 are each passed through a swivel block 72, the locking cleat 74, opening 78 in the hatch 76, and opening 85 in the web section 84 of the channel 46 to the take-up reel 80 upon which the distal end portion of the line is coiled.

The line portions *22a* and *24a* between the locking cleats 74 and opening 78 should be long enough to be easily grasped by the sailor for elevation from the deck to a position releasing the line from the gripper cam portions of the cleat 74. A fairlead on the cleat keeps the line from escaping. When the line is to be cleated, the line portion *22a* or *24a* is pressed down upon and between the cam portions of the cleat which are spring-loaded to engage and grip te line therebetween and hold it firmly against release.

The manually operable rudder control mechanism 26 comprises generally the hand-held lever member 88, the universal joint coupling 90 (or other suitable coupling means) fixedly secured to the proximal end of the lever 88 and to the distal end of the central rudder control bell crank and the rudder mechanism described in my earlier-filled application Ser. No. 584,124.

The masthead fitting 21 comprises a body 90 having arms 92, 94 of dissimilar length extending from a bearing portion 96 through which a screw-type fastener or pivot pin 98 is passed for securement to a nut 100 or other suitable means fixedly secured or attached to the top end of the mast 18. The lengths of the arms 92,94 are preferably in a ratio of about 1:2 or greater, respectively. A thrust bearing 102 is positioned upon the mast end portion 104 and within the counterbore 106 of the tubular extension or hub 108 axially aligned with the bearing portion 96. The fitting 21 freely revolves and swivels about the mast end portion 104.

Recesses 110 and 112 within the arms 92 and 94 respectively have pulleys or grooved rollers 114,114 rotatably mounted therein on horizontal pivot pins or shafts 115,115 adjacent openings 116,118 respectively. the halyard 120 is passed over and upon the pulleys 114,114, and one end portion 122 is passed through the longer arm 94 and provided with a snap fastener or clip engaging a grommet or other member affixed to the peak end of the sail 20. The remaining halyard portion 124 is passed over the other roller 114, through opening 116, and tied to the mast-affixed cleat 126 in the region where the sailor stands and can easily engage the halyard, once the sail has been raised to the masthead fitting 21, or disengage it for sail removal.

The sail 20 comprises the body portion 130 in which a pair of windows 132,132, made of a suitable clear flexible material such as mylar, are affixed in the body portion so that the sailor, who will stand only on one side of the mast and sail, can look through the windows to the far side of the boat.

The lower and upper boat sections 28 and 30 respectively are preferably made of molded plastic materials, the mast of aluminum or wood, and the sail of dacron or equivalent fabric material.

OPERATION

The sailboat 10 is operated in the following manner. The mast 18 is readily and removably mounted in the mast support sleeve 56 by telescopically inserting the lower end of the mast into the bearing members 58 and 60. The peak of the sail 20 is first raised by the halyard 120 to the masthead fitting 21 and the halyard portion 124 tied to the mast cleat 126. The swiveling masthead fitting 21 revolves upon the mast top portion 104 toward the side to which the sail is drawn taut, the longer arm 94 swinging in the direction of the luff that is drawn taut, thus advancing the point of pressure effort of the wind forward of the mast in the direction in which the sailor desires to go, i.e., the direction of the sail drawn taut by the line 22 or 24.

Figure 1:
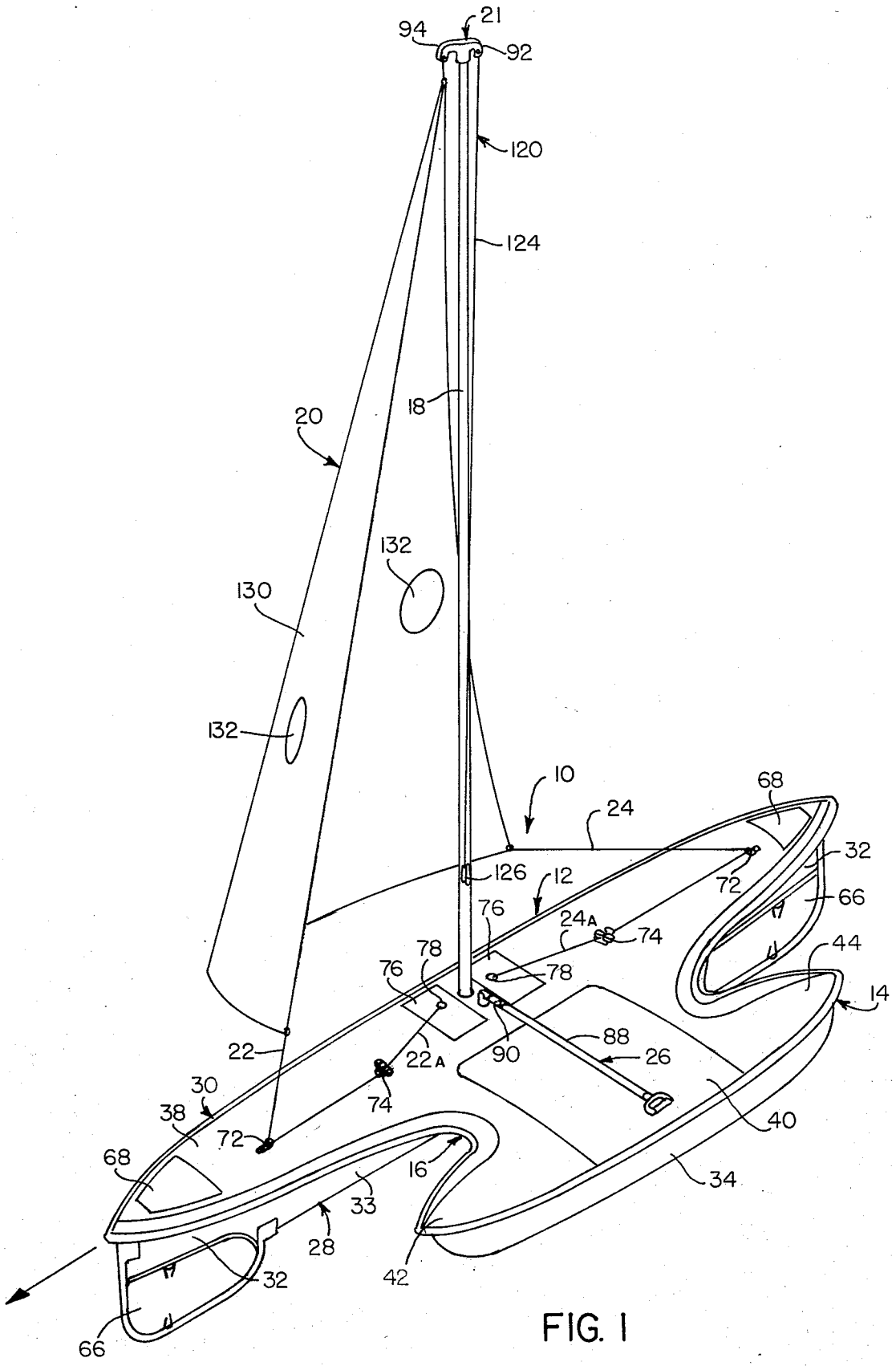

As shown more particularly in FIG. 1, the sailboat 10 will move in the direction of the arrow, i.e., to the left of the sailor who will normally be standing on the deck portion 40. The boat will move in that direction because line 22 is drawn taut through the swiveling block 72 and the gripper cams of the locking cleat 74 so that the left luff of the sail 20 and the masthead fitting portion 94 places the point of pressure effort to the left of the mast, causing the boat to move to the left under wind pressure.

The sailor grasps the rudder control lever 88 in his left hand and the line portion **24*a* in his right hand, releasing line 24 from the gripper cams of the locking cleat 74 and allowing the body of the sail 130 to move outwardly under wind pressure to form the desired airfoil in the sail. The body of the sail is trimmed by manipulation of the line 24 to optimum form as the sailor adjusts to the wind pressure and direction, adjustably rotating the rudders 66 by his manipulation of the rudder control lever 88**.

Figure 2:
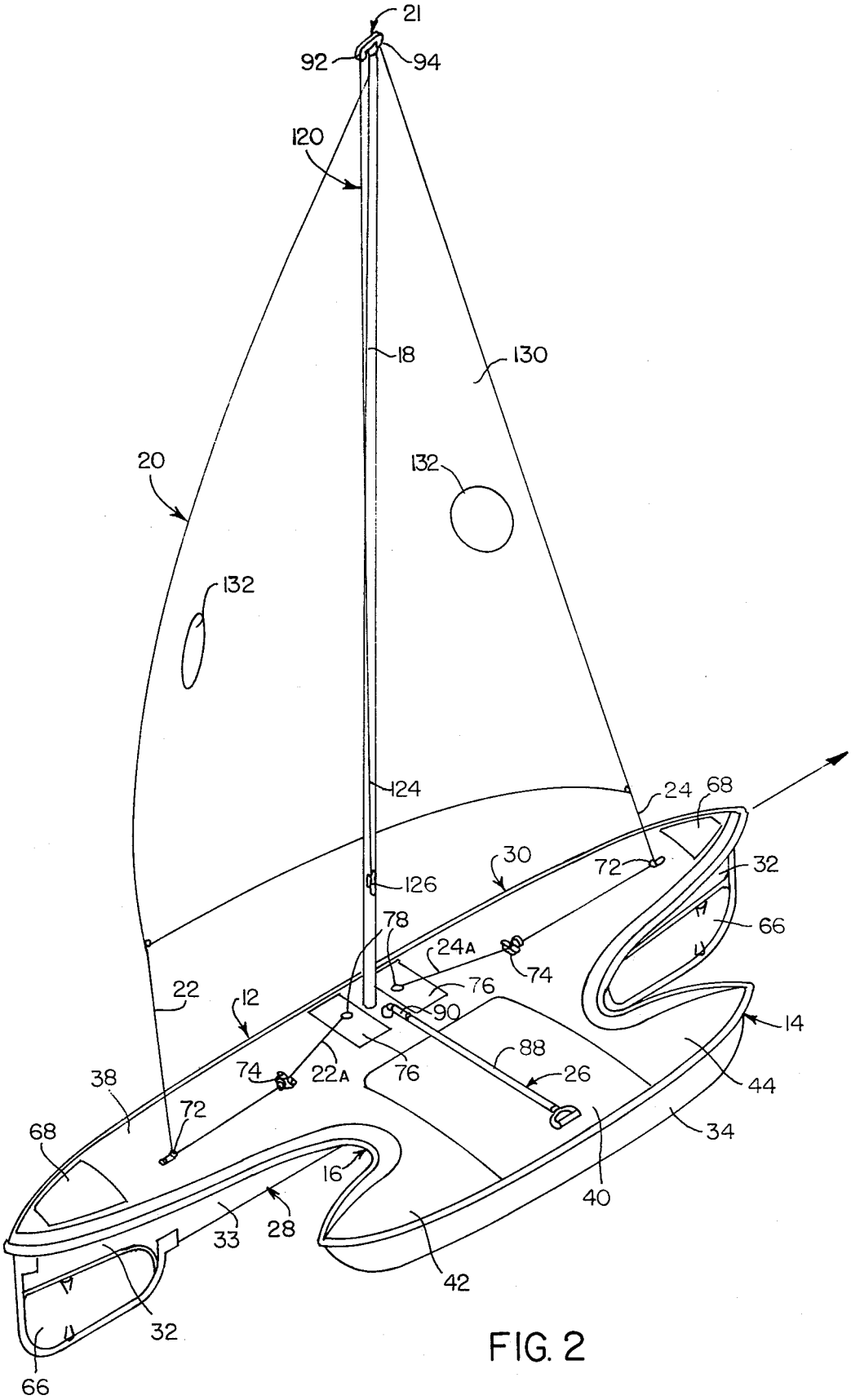
FIG. 2 is a perspective view similar to FIG. 1, but showing the line connected to the lower right corner of the sail cleated and engaged, with the right luff drawn taut, for sailing the boat in a direction to the right of the mast.

To reverse the direction of the boat, the sailor first releases line portion **22*a* from the locking cleat 74 with which it is engaged, allowing the line 22 to run freely under wind pressure from the reel 80. He then draws the line 24 and the right luff taut by pulling line portion 24*a* up, and engages that line in the gripper cams of its locking cleat 74. Upon drawing line 24 taut, the right leading edge of the sail and arm 94 of the masthead fitting 21 are brought about to the right of the mast 18, as shown in FIG. 2. The sailor then takes hold of the rudder control lever 88 in his right hand and the line portion 22*a* in his left hand for trimming the sail 20 to the desired airfoil, causing the boat now to move to the right under wind pressure, as shown in FIG. 2**.

It will thus be observed that the boat will steer in either direction without being brought about. The rudder control lever 88 is used by the sailor not only for steering the boat but also for balancing himself upon the platform 40 where he normally stands. The surface of the platform portion is preferably knurled or roughened so that slipping is substantially reduced. In some instances, slip-resistant coverings can be applied and secured to the platform portion 40 by adhesives or other suitable means to provide a non-skid surface for the sailor.

When the line portion **22*a* or 24*a* is released by the sailor, the reel 80 to which that portion is tied will recoil that line portion until it is relatively taut with the adjacent locking cleat 74, thereby removing excess line from the deck, eliminating tangling of the line with the feet of the sailor standing on the platform portion 40. Yet, the line portion 22*a* or 24*a*** is freely exposed and available to the sailor for grasping, to control the direction of the boat as described above.

A substantial improvement resides in the omission of a boom along or adjacent the lower horizontal portion of the sail connecting its two lower corners. The sail 20 is more easily trimmed and its airfoil configuration more readily formed to effect optimum speed and sailing of the boat. Upon trimming the sail to the desired airfoil and under adequate wind pressure, the outboard pontoon 14 rises from the water and the boat 10 sails on the main hull 12. As the wind pressure on the sail 20 lessens, either by virtue of the wind dropping in intensity or the sail being trimmed to spill the wind more fully, the outboard pontoon 14 lowers into the water, reducing the forward speed of the boat.

Although the sail 20 is normally not provided with a boom along its lower horizontal edge and the airfoil of the sail can be more freely and adjustably formed by the sail control lines without a boom to achieve the desired sailing effect, it is to be understood by persons skilled in the art to which the invention pertains that when the sail body 130 is formed in such a way that it achieves a favorable airfoil configuration with a boom adjacent or across its lower horizontal edge, such sail is considered to come within the compass of this invention. In such event, the lines 22 and 24 can be connected at their proximal ends to the boom, or to the lower corners of the sail body as described.

As an optional or governmentally required component, all or any of the main hull lower portion 32 and keel portion 33, the intermediate lower web portion 36 and the lower outboard pontoon portion 34 can be partially or wholly filled with a plastic foam flotation material to provide buoyancy for the sailboat.

Although a particular preferred embodiment of the invention has been disclosed herein for purposes of explanation, further modifications or variations thereof, after study of this specification, will or may become apparent to those skilled in the art to which the invention pertains. Reference should be had to the appended claims in determining the scope of the invention.

I claim:

1. In a sailing craft having a unitary main hull, outboard pontoon and intermediate web and platform chambered structure, a mast mounted on said main hull substantially medially of its length, a sail depending from said mast and manually operable sail control means, the improvement residing in said sail control means and comprising in combination a line to control said sail connected to each lower corner of said sail, a block or equivalent guide means for each said line secured to and upon said main hull, a locking cleat or equivalent line holding means for releasably gripping each said line secured to and upon said main hull, and a line take-up reel for each said line secured to said structure, each said line extending from said sail corner and being threaded through said block or equivalent line guide means and said locking cleat or equivalent line holding means to connection with said line take-up reel.

2. The improved structure defined in claim 1, wherein each said block is secured to and upon the main hull portion of said structure in the area adjacent each longitudinal end of said main hull portion.

3. The improved structure defined in claim 1, wherein each said locking cleat is secured to and upon the main hull portion of said structure in the area intermediate said blocks and said mast and intermediate web and platform portion of said structure.

4. The improved structure defined in claim 1, wherein each said line take-up reel is secured to said structure relatively adjacent the medial portion thereof.

5. The improved structure defined in claim 4, wherein each said reel is mounted within the main hull portion of said chambered structure, said main hull portion having an opening thereinto for passage of said line to said take-up reel.

6. The improved structure defined in claim 4, wherein each said line take-up reel is adapted to releasably coil the distal end of said line connected thereto and draw said line relatively taut between said reel and said locking cleat.

7. The improved structure defined in claim 4, wherein each said line take-up reel is spring-loaded to automatically coil said line thereon and to draw said line releasably taut between said reel and said locking cleat.

8. The improved structure defined in claim 1, wherein said locking cleat is provided with a fairlead to pass said line therethrough and maintain said line on said cleat for selectively gripping said line.

9. The improved structure defined in claim 1, and wherein said sail control means includes a swiveling masthead fitting rotatably mounted upon said mast at its top end and comprising a body having arms of dissimilar lengths, rollers mounted on said arms for supporting a halyard thereon to raise and lower said sail peak to and from said masthead fitting.

10. In a sailing craft having a unitary lower section comprising a main hull, an outboard pontoon and an intermediate web portion therebetween, a unitary upper section comprising the cover for said main hull, outboard pontoon and intermediate web portion, said unitary lower and upper sections being conjoined at their peripheral edges to form a unitary main hull, outboard pontoon and intermediate web chambered structure, a sail and a mast for said craft, said mast being removably mounted and supported upright upon said main hull substantially medially of its length, said sail being removably and pivotally secured upon said mast adjacent its upper end and depending and extending downwardly therefrom on that side of said mast remote from said outboard pontoon, manually operable sail control means connected to the lower corner portions of said sail to pivot said sail from said mast upper end, rudder means for said craft pivotally mounted for rotation upon said main hull at each longitudinal end thereof and substantially in a plane passed through the longitudinal axis of said main hull, and manually operable rudder control means on said main hull connected to said rudder means, the improvement residing in said sail control means which comprises in combination a line to control said sail connected to each lower corner of said sail, a block or equivalent guide means for each said line secured to and upon the main hull portion of said structure, a locking cleat or equivalent line holding means for releasably gripping each said line secured to and upon the main hull portion of said structure, and a line take-up reel for each said line secured to said structure, each said line extending from said sail corner and being threaded through said block or equivalent line guide means and said locking cleat or equivalent line holding means to connection with said line take-up reel.

11. The sailing craft defined in claim 10, wherein said rudder means comprises in part a rotatable rudder depending from and adjacent each end of said main hull.

12. The sailing craft defined in claim 10, wherein said unitary upper section main hull cover portion is further provided with hatches covering openings into said main hull.

13. The sailing craft defined in claim 10, wherein said unitary upper section comprises in part an intermediate web and platform portion overlying said lower section web and outboard pontoon portions for a craft operator to stand, kneel or sit on.

14. The sailing craft defined in claim 10, wherein said sail is substantially triangular in configuration and having a peak, and a halyard removably connected to said sail peak.

15. The sailing craft defined in claim 14, wherein said mast is provided at its upper end with a swiveling masthead fitting affixed thereto, said halyard being movably operative on said fitting for raising and lowering said sail peak to and from said mast upper end.

16. The sailing craft defined in claim 10, wherein said outboard pontoon is substantially shorter in length than said main hull.

17. The sailing craft defined in claim 10, wherein each said block is secured to and upon the main hull of said structure in the area adjacent each longitudinal end of said main hull portion.

18. The sailing craft defined in claim 10, wherein each said locking cleat is secured to and upon the main hull portion of said structure in the area intermediate said blocks and said mast and intermediate web and platform portion of said structure.

19. The sailing craft defined in claim 10, wherein each said line take-up reel is secured to said structure relatively adjacent the medial portion thereof.

20. The sailing craft defined in claim 19, wherein each said reel is mounted within the main hull portion of said chambered structure, said main hull portion having an opening thereinto for passage of said line to said take-up reel.

21. The sailing craft defined in claim 19, wherein each said line take-up reel is adapted to releasably coil the distal end of said line connected thereto and draw said line relatively taut between said reel and said locking cleat.

22. The sailing craft defined in claim 19, wherein each said line take-up reel is spring-loaded to automatically coil said line thereon and to draw said line releasably taut between said reel and said locking cleat.

23. The sailing craft defined in claim 10, wherein said locking cleat is provided with a fairlead to pass said line therethrough and maintain said line on said cleat for selectively gripping said line.

24. The sailing craft defined in claim 10, and wherein said sail control means includes a swiveling masthead fitting rotatably mounted upon said mast as its top end and comprising a body having arms of dissimilar lengths, rollers mounted on said arms for supporting a halyard thereon to raise and lower said sail peak to and from said masthead fitting.

25. The sailing craft defined in claim 11, wherein said lower main hull portion is provided with a keel portion extending from and between one said rudder to the other said rudder.

* * * * *